US005256332A

United States Patent [19]

Kessler

[11] Patent Number: 5,256,332

[45] Date of Patent: Oct. 26, 1993

[54] METHOD OF INHIBITING CORROSION IN AQUEOUS SYSTEMS

[75] Inventor: Stephen M. Kessler, Fairless Hills, Pa.

[73] Assignee: Betz Laboratories, Inc., Trevose, Pa.

[21] Appl. No.: 978,831

[22] Filed: Nov. 19, 1992

[51] Int. Cl.[5] ..... C23F 11/12; C02F 5/10

[52] U.S. Cl. ..... 252/396; 252/389.62; 252/389.23; 252/394; 252/395; 210/696; 210/698; 210/700; 422/16; 422/17

[58] Field of Search ..... 252/389.23, 389.62, 252/394, 395, 396; 422/16, 17; 210/696, 698, 700

[56] References Cited

U.S. PATENT DOCUMENTS 4,869,845 9/0525 54359 ..... 252/181
5,062,962 11/1991 Brown et al. ..... 210/698

*Primary Examiner*—Robert L. Stoll
*Assistant Examiner*—Valerie Fee
*Attorney, Agent, or Firm*—Alexander D. Ricci; Gregory M. Hill

[57] ABSTRACT

A low phosphorus process for controlling corrosion in aqueous systems by adding to the aqueous system an effective amount of a composition comprising orthophosphate, azole, polyepoxysuccinic acid and the copolymer of acrylic acid and allyl hydroxypropyl sulfonate ether.

8 Claims, No Drawings

METHOD OF INHIBITING CORROSION IN AQUEOUS SYSTEMS

FIELD OF THE INVENTION

The present invention relates to the treatment of aqueous systems to reduce corrosion on the metallic surfaces in contact therewith. The inhibition of corrosion is especially desirable where heat transfer dynamics require clean surfaces.

BACKGROUND OF THE INVENTION

The problems of corrosion and attendant effects such as pitting have troubled water systems for years. For instance, scale tends to accumulate on internal walls of various water systems, such as boiler and cooling systems, and thereby materially lessens the operational efficiency of the system. In this manner, heat transfer functions of,the particular system are severely impeded.

Corrosion is a degradative electrochemical reaction of a metal with its environment. Simply stated, it is the reversion of refined metals to their natural state. For example, iron ore is iron oxide. Iron oxide is refined into steel. When the steel corrodes, it forms iron oxide which, if unattended, may result in failure or destruction of the metal, causing the particular water system to be shut down until the necessary repairs can be made.

Typically in cooling water systems, corrosion along with pitting has proven deleterious to the overall efficiency of the cooling water system. Recently, due to the popularity of cooling treatments using orthophosphate to promote passivation of the metal surfaces in contact with the system water, it has become critically important to maintain relatively high levels of orthophosphate in the system to achieve the desired passivation without resulting in fouling or impeded heat transfer functions.

Environmental regulations have begun to impose increasingly more severe restrictions on the discharge of phosphate from industrial processes into local rivers and streams. Phosphates originally evolved as a viable alternative to zinc based industrial water system treatment programs which were severely restricted due to their high toxicity to fish and other aquatic life.

Recent environmental regulations in the Great Lakes area restricts the discharge-of phosphorus (P) to a maximum of 1 ppm. Current industrial corrosion technology fails to meet these severe discharge limits. These programs rely greatly on the effective corrosion inhibiting properties of inorganic and organic phosphate combinations at levels far in excess of the 1ppm P discharge limit.

It is an object of this invention to provide industrial water users with an effective corrosion inhibiting treatment program which complies with environment standards for the discharge of less than 1 ppm P.

DETAILED DESCRIPTION OF THE INVENTION

The present invention provides an effective low phosphorus method for controlling the corrosive attack of metallic surfaces in contact with aqueous systems. Examples of such systems include metal processing, cooling towers and wastewater processing. Specifically, the method of the present invention comprises adding to the aqueous environment a blend of effective amounts of orthophosphate, a polyepoxysuccinic acid (PESA), a water soluble azole compound and the copolymer of acrylic acid and an allyl hydroxy propyl sulfonate ether monomer. The polyepoxysuccinic acid material employed in the present invention can be obtained by the polymerization of epoxysuccinate in the presence of calcium hydroxide or other alkaline calcium slats. The general reaction can be represented as follows:

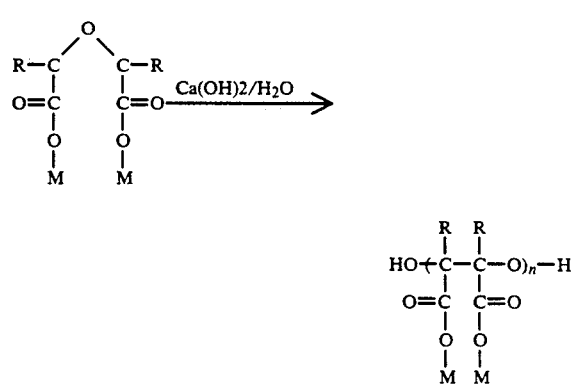

wherein M is hydrogen or a cation wherein the resultant salt is water soluble, preferably an alkali metal, ammonium or substituted ammonium cation, n is from about 2 to about 15 (preferably n is from about 2 to about 10) and each R is the same or different and selected from hydrogen, $C_{1-4}$ alkyl or $C_{1-4}$ substituted alkyl.

A complete description of one method of preparing such a polyepoxysuccinic acid is included in U.S. Pat. No. 4,654,159, incorporated herein by reference.

The arylic acid/allyl hydroxy propyl sulfonate ether copolymer employed in the present invention comprises the structure:

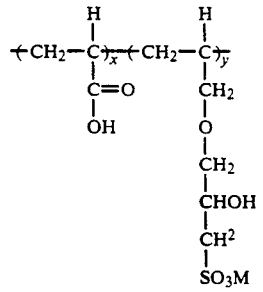

wherein M is a water soluble cation. This polymer is referred to as acrylic acid/allyl hydroxy propyl sulfonate ether (AA/AHPSE). The IUPAC nomenclature for AHPSE is 1-propane sulfonic acid, 2-hydroxy-3-(2-propenyl oxy)-mono sodium salt.

The polymer has a number average molecular weight (mw) in the range of 1,000 to 8,000. Preferably, mw will fall within the range of 2,000 and 4,000. The x:y molar ratio of the monomers may fall in the range of between 10:1 to 1:5. However, the preferred molar ratio is about 3:1.

The water soluble azole compounds employed by the present invention have the Formula:

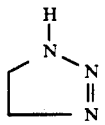

Included within the scope of the invention are N-alkyl substituted 1,2,3-triazole, or a substituted water soluble 1,2,3-triazole where substitution occurs at the 4 and/or 5 position of the ring. The preferred 1,2,3-triazole is 1,2,3-tolyltriazole of the formula:

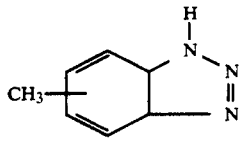

Other exemplary 1,2,3-triazoles include benzotriazole, 4-phenol-1,2,3-triazole, 4-methyl-1,2,3-triazole, 4-ethyl-1,2,3-triazole, 5-methyl-1,2,3 triazole, 5-ethyl-1,2,3-triazole, 5-propyl-1-2-3 triazole, and 5-butyl-1,2,3-triazole. Alkali metal or ammonium salts of these compounds may be used.

The orthophosphate employed in this invention may be derived from any one of a number of sources capable of generating the orthophosphate ion. Such sources include inorganic phosphoric acids, phosphonic acid salts, and organic phosphoric acid esters.

Examples of such inorganic phosphoric acids include condensed phosphoric acids and water soluble salts thereof. The phosphoric acids include an orthophosphoric acid, a primary phosphoric acid and a secondary phosphoric acid. Inorganic condensed phosphoric acids include polyphosphoric acids such as pyrophosphoric acid, tripolyphosphoric acid and the like, metaphosphoric acids such as trimetaphosphoric acid, and tetrametaphosphoric acid.

As to the other phosphonic acid derivatives which are to be added in addition to the polymers of the present invention, there may be mentioned aminopolyphosphonic acids such as aminotrimethylene phosphonic acid, ethylene diaminetetramethylene phosphonic acid and the like, methylene diphosphonic acid, hydroxyethylidene diphosphonic acid, 2-phosphonobutane 1,2,4, tricarboxylic acid, etc.

Exemplary organic phosphoric acid esters include phosphoric acid esters of alkyl alcohols such as methyl phosphoric acid ester, ethyl phosphoric acid ester, etc., phosphoric acid esters of methyl cellosolve and ethyl cellosolve, and phosphoric acid esters of polyoxyalkylated polyhydroxy compounds obtained by adding ethylene oxide to polyhydroxy compounds such as glycerol, mannitol, sorbitol, etc. Other suitable organic phosphoric esters are the phosphoric acid esters of amino alcohols such as mono, di, and tri-ethanol amines.

Inorganic phosphoric acid, phosphonic acid, and organic phosphoric acid esters may be salts, preferably salts of alkali metal, ammonia, amine and so forth.

The method of the present invention comprises adding to the aqueous environment amounts of the compounds described above effective to control the corrosion of the surfaces of the metals in contact therewith. The following concentration ranges may be employed:

| | |
|---|---|
| orthophosphate | 1-6 ppm, preferably 2-4 ppm |
| PESA | 1-40 ppm, preferably 10-20 |
| AA/AHPSE | 1-40 ppm, preferably 5-10 |
| azole | 1-10 ppm, preferably 3-6 |

The above ingredients may be added separately neat to the aqueous system to be treated or they may be first blended in an aqueous solution at the discretion of the user. The treatment blend may be added either continuously or intermittently. Alternatively, a pretreatment dosage of the blended compounds may be added followed by smaller quantities as a maintenance dosage.

EXAMPLES

The invention will now be further described with reference to specific examples which are to be regarded solely as illustrative and not as a limitation on the scope of the invention.

Recirculator Studies

In order to demonstrate the effective corrosion inhibiting properties of the inventive composition, tests were conducted under recirculating heat transfer conditions such as would be experienced in a cooling tower.

In this test system heated water is circulated by a centrifugal pump through a corrosion coupon by-pass into which corrosion coupons are inserted, and past a mild steel (AISI-1010) heat exchanger tube contained in a plexiglass block. The inside of the exchanger tube is filled with wood's metal and heated with an electric heater. The temperature of the wood's metal can be regulated. The water velocity past the corrosion coupons and heat exchanger tube can be controlled anywhere from 0 to 4.5 ft/sec.

The pH and temperature of the bulk water are automatically controlled. The treated water is prepared by chemical addition to deionized water. Provisions for continuous makeup and blowdown are made by pumping fresh treated water from supply tanks to the sump, with overflow from the sump serving as blowdown.

Corrosion rates are determined by exposing precleaned and weighed metal specimens for a specified period of time, after which they are removed, cleaned and reweighed Corrosion rates are calculated by dividing the total coupon weight loss by the number of days of exposure.

The specific conditions employed are: Heat Flux=8,000 BTU/ft$^2$/hr; Water Velocity=3 ft/sec; Water Temperature=120° F.; System Retention Time=1.4 days; low carbon steel (LCS) heat transfer probe and LCS corrosion rate probe, and LCS and admiralty (ADM) coupons.

Water Chemistry: 400 ppm Ca as CaCO3, 150 ppm Mg2+ as CaCO3, 51 ppm SiO2; pH=8.6.

The treatment composition according to the invention as well as comparative treatment compositions are as shown in Table I. The following results were obtained.

TABLE

| Treatment | Concentration (ppm) | Corrosion Rate (mpy) LCS | ADM | Comments |
|---|---|---|---|---|
| A) ortho | 1.6 | 1.3 | 0.0 | moderate to |
| B575 | 2.4 | | | severe pitting |
| TTA | 3.0 | | | corrosion |
| AA/AHPSE | 5.0 | | | |

TABLE-continued

| Treatment | Concentration (ppm) | Corrosion Rate (mpy) LCS | ADM | Comments |
|---|---|---|---|---|
| B) ortho | 3.0 | 1.9 | 0.0 | moderate pitting |
| TTA | 3.0 | | | corrosion and |
| AA/AHPSE | 5.0 | | | deposition |
| C) B575 | 5.0 | 16.0 | 0.1 | moderate to |
| TTA | 3.0 | | | severe general |
| AA/AHPSE | 5.0 | | | corrosion |
| D) HEDP | 3.3 | 37.0 | 0.1 | severe corrosion |
| TTA | 3.0 | | | and deposition |
| AA/AHPSE | 5.0 | | | |
| E) PESA | 15.0 | 13.0 | 0.1 | severe corrosion |
| TTA | 3.0 | | | and deposition |
| AA/AHPSE | 5.0 | | | |
| *F) ortho | 3.0 | 0.5 | 0.2 | clean with only |
| PESA | 15.0 | | | superficial |
| TTA | 3.0 | | | pitting |
| AA/AHPSE | 5.0 | | | |

*corrosion rates are an average of two tests.
Legend:
mpy = mils per year
LCS = low carbon steel
ADM = admiralty brass
ortho = orthophosphate generated from sodium phosphate monobasic
B575 = Belcor 575: hydroxyphosphonoacetic acid
TTA = tolyltriazole as representative azole
AA/AHPSE = 3/1 molar ratio, mw = @ 3,000
HEDP = Dequest 2010: hydroxyethylidene diphosphonic acid
PESA = polyepoxysuccinic acid Clearly superior results were obtained by treatment with composition F. Interestingly, neither the combination of ortho phosphate, TTA and AA/AHPSE copolymer nor the combination PESA with TTA and AA/AHPSE yielded desirable results. In fact, these tests resulted in moderate to severe corrosion of the LCS heat transfer surface.

What has been described herein above is an effective corrosion control composition and method for treating industrial water systems which complies with strict environmental discharge limits of no more than 1 ppm P.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What I claim is:

1. A process for inhibiting corrosion on metallic surfaces in contact with an aqueous medium comprising adding to the aqueous medium a corrosion inhibitor comprising approximately 1 to 6 ppm of orthophosphate, approximately 1 to 10 ppm of a substituted 1,2,3-triazole, selected from the group consisting of tolytriazole, benzotriazole, 4-phenol-1,2,3-triazole, 4-methyl-1,2,3,-triazole, 4-ethyl-1,2,3-triazole, 5-methyl-1,2,3-triazole, 5-ethyl-1,2,3-triazole, 5-propyl-1,2,3-triazole, and 5-butyl-1,2,3-triazole, approximately 1 to 40 ppm of a polyepoxysuccinic acid having the formula:

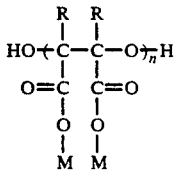

wherein M is hydrogen or a cation wherein the resultant salt is water soluble, R is the same or different and is hydrogen, $C_{1-4}$ alkyl or $C_{1-4}$ substituted alkyl and n is from about 2 to 15, approximately 1 to 40 ppm of an acrylic acid/allyl hydroxy propyl sulfonate ether copolymer wherein the molar ratio of acrylic acid to allyl hydroxy propyl sulfonate ether is between about 10 to 1 and 1 to 5 having an umber average molecular weight between 1,000 and 8,000.

2. The process of claim 1 wherein the metallic surfaces contain low carbon steel.

3. The process of claim 1 wherein the aqueous medium is a cooling tower system.

4. The process of claim 1 wherein approximately 2 to 4 ppm of orthophosphate, 3 to 6 ppm of azole, 10 to 20 ppm of polyepoxysuccinic acid and 5 to 10 ppm of the copolymer of acrylic acid and the allyl hydroxypropyl sulfonate ether monomer is added to the aqueous medium.

5. The process of claim 1 wherein the corrosion inhibitor is added neat to the aqueous medium.

6. The process of claim 1 wherein the corrosion inhibitor is diluted in water prior to addition to the aqueous medium.

7. A corrosion control composition comprising approximately 1 to 6 ppm of orthophosphate, approximately 1 to 10 ppm of a substituted 1,2,3-triazole selected from the group consisting of tolyltriazole, benzotriazole, 4-phenol-1,2,3-triazole, 4-methyl-1,2,3-triazole, 4-ethyl-1,2,3-triazole, 5-methyl-1,2,3-triazole, 5-ethyl-1,2,3-triazole, 5-propyl-1,2,3 triazole, and 5-butyl-1,2,3-triazole, approximately 1 to 40 ppm of a polyepoxysuccinic acid having the formula:

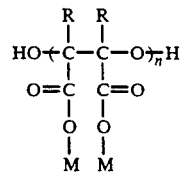

wherein M is hydrogen or a cation wherein the resultant salt is water soluble, R is the same or different and is hydrogen, $C_{1-4}$ alkyl or $C_{1-3}$ substituted alkyl and n is from about 2 to 15, approximately 1 to 40 ppm of an acrylic acid/allyl hydroxy propyl sulfonate ether copolymer wherein the molar ratio of acrylic acid to allyl hydroxy propyl sulfonate ether is between about 10 to 1 and 1 to 5 having a number average molecular weight between 1,000 and 8,000, and the remainder water.

8. The composition of claim 1 wherein approximately 4 to 6 ppm of orthophosphate, 3 to 6 ppm of azole, 10 to 20 ppm of polyepoxysuccinic acid and 5 to 10 ppm of the copolymer of acrylic acid and allyl hydroxypropyl sulfonate ether are present in the water.

* * * * *